US009163459B2

(12) United States Patent
Lebeck

(10) Patent No.: US 9,163,459 B2
(45) Date of Patent: Oct. 20, 2015

(54) ROCK BIT HAVING A PRESSURE BALANCED METAL FACED SEAL

(71) Applicant: Varel International, Ind., L.P., Carrollton, TX (US)

(72) Inventor: Alan Otto Lebeck, Albuquerque, NM (US)

(73) Assignee: Varel International, Ind., L.P., Carrollton, TX (US)

( * ) Notice: Subject to any disclaimer, the term of this patent is extended or adjusted under 35 U.S.C. 154(b) by 296 days.

(21) Appl. No.: 13/766,166

(22) Filed: Feb. 13, 2013

(65) Prior Publication Data

US 2014/0224549 A1 Aug. 14, 2014

(51) Int. Cl.
*E21B 10/25* (2006.01)

(52) U.S. Cl.
CPC ..... *E21B 10/25* (2013.01)

(58) Field of Classification Search
CPC ..... E21B 10/25; E21B 2010/225
See application file for complete search history.

(56) References Cited

U.S. PATENT DOCUMENTS

| | | | | | |
|---|---|---|---|---|---|
| 3,572,452 | A | * | 3/1971 | Winberg | 175/371 |
| 4,172,502 | A | * | 10/1979 | van Nederveen | 175/369 |
| 4,199,156 | A | | 4/1980 | Oldham et al. | |
| 4,249,622 | A | | 2/1981 | Dysart | |
| 4,388,984 | A | * | 6/1983 | Oelke | 184/54 |
| 4,494,749 | A | | 1/1985 | Evans | |
| 4,516,641 | A | | 5/1985 | Burr | |
| 4,519,719 | A | | 5/1985 | Burr | |
| 4,623,028 | A | * | 11/1986 | Murdoch et al. | 175/371 |
| 4,629,338 | A | * | 12/1986 | Ippolito | 384/94 |
| 4,666,001 | A | | 5/1987 | Burr | |
| 4,671,368 | A | | 6/1987 | Burr | |
| 4,722,404 | A | | 2/1988 | Evans | |
| 4,747,604 | A | | 5/1988 | Nakamura | |
| 4,753,303 | A | | 6/1988 | Burr | |
| 4,762,189 | A | * | 8/1988 | Tatum | 175/371 |
| 4,792,146 | A | | 12/1988 | Lebeck et al. | |
| 4,822,057 | A | * | 4/1989 | Chia et al. | 277/383 |

(Continued)

FOREIGN PATENT DOCUMENTS

| | | | | |
|---|---|---|---|---|
| EP | 0282431 | | 7/1883 | |
| EP | 0040845 | A2 * | 2/1981 | E21B 10/22 |

(Continued)

OTHER PUBLICATIONS

International Search Report and Written Opinion for PCT/US2013/071228 mailed Feb. 24, 2014 (9 pages).

*Primary Examiner* — Jennifer H Gay
(74) *Attorney, Agent, or Firm* — Gardere Wynne Sewell LLP; Andre M. Szuwalski

(57) ABSTRACT

A sealing system includes a first gland in a cone and a first ring mounted in the first gland. A second ring is mounted to a shaft region. A third ring is positioned between the first and second rings. The first and third rings present a pair of metal seal faces. A second gland is formed between the second and third rings, with an o-ring sealing member installed within the third gland and radially compressed in a sealing relationship between the second and third rings. The second gland is sized to permit axial movement of the o-ring sealing member within the second gland in response to pressure changes. An energizer is configured to exert an axial force against the third ring so as to keep the metal seal faces in sealing contact. The axial force is applied at a radial position corresponding to a radial center the metal seal faces.

29 Claims, 10 Drawing Sheets

(56) References Cited

U.S. PATENT DOCUMENTS

| | | | | | |
|---|---|---|---|---|---|
| 4,824,123 | A * | 4/1989 | Chia et al. | 277/382 |
| 4,834,400 | A | 5/1989 | Lebeck | |
| 4,836,561 | A | 6/1989 | Lebeck et al. | |
| 4,838,365 | A * | 6/1989 | Kotch | 175/371 |
| 4,887,395 | A | 12/1989 | Lebeck et al. | |
| 4,903,786 | A | 2/1990 | Welsh | |
| 4,923,020 | A | 5/1990 | Kelly, Jr. et al. | |
| 4,973,068 | A | 11/1990 | Lebeck | |
| 5,040,624 | A | 8/1991 | Schumacher et al. | |
| 5,080,183 | A | 1/1992 | Schumacher et al. | |
| 5,251,914 | A * | 10/1993 | Tatum | 277/363 |
| 5,295,549 | A | 3/1994 | Dolezal et al. | |
| 5,360,076 | A | 11/1994 | Kelly, Jr. et al. | |
| 5,513,715 | A * | 5/1996 | Dysart | 175/371 |
| 5,740,871 | A * | 4/1998 | Williams | 175/371 |
| 5,791,421 | A | 8/1998 | Lin | |
| 6,003,875 | A | 12/1999 | Ellis et al. | |
| 6,026,917 | A | 2/2000 | Zahradnik et al. | |
| 6,045,029 | A | 4/2000 | Scott | |
| 6,109,376 | A * | 8/2000 | Pearce | 175/371 |
| 6,176,330 | B1 | 1/2001 | Burr | |
| 6,209,185 | B1 | 4/2001 | Scott | |
| 6,213,473 | B1 | 4/2001 | Lebeck | |
| 6,247,545 | B1 * | 6/2001 | Burr et al. | 175/371 |
| 6,254,275 | B1 * | 7/2001 | Slaughter et al. | 384/92 |
| 6,401,843 | B1 * | 6/2002 | Besson et al. | 175/359 |
| 6,427,790 | B1 * | 8/2002 | Burr | 175/371 |
| 6,513,607 | B2 * | 2/2003 | Peterson et al. | 175/371 |
| 6,684,966 | B2 | 2/2004 | Lin et al. | |
| 6,918,594 | B2 | 7/2005 | Sund et al. | |
| 7,117,961 | B2 * | 10/2006 | Yong et al. | 175/371 |
| 7,128,173 | B2 | 10/2006 | Lin | |
| 7,188,691 | B2 | 3/2007 | Yong et al. | |
| 7,311,159 | B2 | 12/2007 | Lin et al. | |
| 7,347,290 | B2 * | 3/2008 | Yu et al. | 175/372 |
| 7,413,037 | B2 | 8/2008 | Lin et al. | |
| 7,887,061 | B2 * | 2/2011 | Van Dyke et al. | 277/382 |
| 8,752,655 | B2 * | 6/2014 | Gallifet | 175/371 |
| 8,783,385 | B2 * | 7/2014 | Lu | 175/371 |
| 8,967,301 | B2 * | 3/2015 | Curry et al. | 175/371 |
| 2002/0108788 | A1 * | 8/2002 | Peterson et al. | 175/228 |
| 2005/0023042 | A1 * | 2/2005 | Yong et al. | 175/372 |
| 2005/0274549 | A1 * | 12/2005 | Yong et al. | 175/371 |
| 2005/0274550 | A1 * | 12/2005 | Yu et al. | 175/372 |
| 2008/0179103 | A1 * | 7/2008 | Langford et al. | 175/371 |
| 2009/0107731 | A1 | 4/2009 | Fedorovich | |
| 2010/0102513 | A1 * | 4/2010 | Peterson | 277/336 |
| 2011/0297448 | A1 | 12/2011 | Lu | |
| 2012/0160561 | A1 | 6/2012 | Ramirez Santiago | |
| 2013/0020135 | A1 * | 1/2013 | Gallifet | 175/371 |
| 2014/0224547 | A1 * | 8/2014 | Lebeck | 175/371 |
| 2014/0224548 | A1 * | 8/2014 | Lebeck | 175/371 |
| 2014/0224549 | A1 * | 8/2014 | Lebeck | 175/371 |

FOREIGN PATENT DOCUMENTS

| | | | | |
|---|---|---|---|---|
| EP | 0202190 | A1 | 11/1986 | |
| EP | 0716253 | A1 * | 6/1996 | F16J 15/34 |
| EP | 0821132 | A2 | 1/1998 | |

* cited by examiner

ROCK BIT HAVING A PRESSURE BALANCED METAL FACED SEAL

CROSS-REFERENCE TO RELATED APPLICATIONS

This application is subject matter related to, and incorporates by reference, the following commonly assigned and co-pending applications for patent: ROCK BIT HAVING A RADIALLY SELF-ALIGNING METAL FACED SEAL, by Alan O. Lebeck, application Ser. No. 13/766,049, filed Feb. 13, 2013; and ROCK BIT HAVING A FLEXIBLE METAL FACED SEAL, by Alan O. Lebeck, application Ser. No. 13/766,118, filed Feb. 13, 2013.

BACKGROUND

1. Technical Field

The present invention relates to earth boring bits, and more particularly to those having rotatable cutters, also known as cones.

2. Description of Related Art

Earth boring bits with rolling element cutters have bearings employing either rollers as the load carrying element or with a journal as the load carrying element. The use of a sealing means in such rock bit bearings has dramatically increased bearing life in the past fifty years.

Early seals for rock bits were designed with a metallic Belleville spring clad with an elastomer, usually nitrile rubber (NBR). The metallic spring provided the energizing force for the sealing surface, and the rubber coating sealed against the metal surface of the head and cone and provided a seal on relatively rough surfaces because the compliant behavior of the rubber coating filled in the microscopic asperities on the sealing surface. Belleville seals of this type were employed mainly in rock bits with roller bearings. The seal would fail due to wear of the elastomer after a relatively short number of hours in operation, resulting in loss of the lubricant contained within the bearing cavity. The bit would continue to function for some period of time utilizing the roller bearings without benefit of the lubricant.

A significant advancement in rock bit seals came when o-ring type seals were introduced. These seals were composed of nitrile rubber and were circular in cross section. The seal was fit into a radial gland formed by cylindrical surfaces between the head and cone bearings, and the annulus formed was smaller than the original dimension as measured as the cross section of the seal. The o-ring seal was then radially squeezed between the cylindrical surfaces.

To minimize sliding friction and the resultant heat generation and abrasive wear, rotating O-rings are typically provided with a minimal amount of radial compression. However, reciprocating (Belleville) seals must have a much larger radial compression to exclude contamination from the sealing zone during axial sliding (typically about twice the compression). The rock bit seal must both exclude contamination during relative head/cone axial motion and minimize abrasive wear during rotation.

Reference is now made to FIG. 1 which illustrates a prior art configuration for an earth boring bit. FIG. 2 illustrates a close-up view of the prior art configuration focusing on the area of a sealing system 2 associated with a rotating cone 4 installed on a shaft 6 of a bit head 8. An o-ring seal 10 is inserted into a seal gland 12 and squeezed between a cone sealing surface 14 and a head sealing surface 16.

Reference is now made to FIG. 3 which illustrates a prior art configuration for an earth boring bit. FIG. 4 illustrates a close-up view of the prior art configuration focusing on the area of a sealing system 22 associated with a rotating cone 24 installed on a shaft 26 of a bit head 28. A first ring 30 is press-fit into a gland 32 formed in the cone 24. The first ring 30 presents a first metal seal face 34. A second ring 36 is also placed in the gland 32. The second ring 36 presents a second metal seal face 38. An energizing structure 40 is also placed in the gland 32 and configured to apply a combination of axial and radial force against a back surface 42 of the second ring 36 so as to urge the second metal seal face 38 into contact with the first metal seal face 34. The structure shown in FIG. 4 illustrates the well-known single energizer type of metal faced sealing system.

In all configurations of metal faced sealing structures, the sealing system 22 must be provided with sufficient force through the energizing structure 40 to maintain sufficient sealing contact (between the second metal seal face 38 and first metal seal face 34) and further to overcome any pressure differential between internal and external zones. Pressure differentials between those zones fluctuate as the cone is contorted on the bearing during operation. This phenomenon is known in the art as "cone pumping." Cone pumping throws an internal pressure surge at the metal faced bearing seal which can lead to catastrophic failure of the seal over time. In addition, changes in depth while the bit is in use can cause fluctuations in pressure between the internal pressure and the external pressure. Conversely, application of too much force on the seal by the energizing structure 40 can cause difficulties in assembling the cone to the bearing and may result in accelerated wear of the first and second rings 30 and 36. It is important that the metal seal faces 34 and 38 are flat, and so a lapping of the surfaces is often provided (in the light band range).

A significant challenge with the single energizer type of metal faced sealing system shown in FIG. 4 is that the press fitting of the first ring 30 in the cone gland 32 may deform the first ring and produce a "waviness" in the first metal seal face 34. The second ring 36 with second metal seal face 38 must overcome this surface waviness through the force applied by the energizing structure 40 so as to maintain the desired sealing contact (otherwise the seal will leak).

An additional challenge with the single energizer type of metal faced sealing system shown in FIG. 4 is that the elastomeric energizing structure 40 is offset so as to apply force to the second ring 36 not only in the preferred axial direction but also in the radial direction. The sealing force is accordingly dissipated by the wasted force component applied in the radial direction. The radially applied force component further introduces a torque on the second ring 36 which reduces (i.e., narrows) the radial width of the effective sealing surface where the metal seal faces 34 and 38 make sealing surface contact. This occurs because of a distortion of the seal ring resulting from press-fitting that causes an out-of-flatness surface characteristic for the face of the seal ring.

Yet another challenge with the single energizer type of metal faced sealing system shown in FIG. 4 is that the metal seal faces 34 and 38 become unloaded as a result of an increase in grease pressure. For example, rock bit bearings may operate with an internal pressure greater than the environment. As a result, grease leakage may occur.

Notwithstanding the foregoing challenges, metal faced sealing systems are often used in roller cone drill bits which operate at higher RPM drilling applications because the metal seal faces 34 and 38 resist wear and consequently exhibit longer operating life than a standard O-ring type sealing system like that shown in FIGS. 1 and 2.

The foregoing challenges remain an issue and thus a need exists in the art for an improved metal faced sealing system for use in rock bits.

SUMMARY

In an embodiment, a sealing system for a drill bit including a shaft region and a rotating cone comprises: a first annular gland defined in the rotating cone; a first ring mounted in the first annular gland and having a first metal seal face; a second ring mounted at a base of the shaft region; a third ring positioned between the first and second rings, said third ring including a second metal seal face in contact with the first metal seal face and further including a biasing surface axially opposite the second metal seal face; and an energizing structure mounted adjacent second ring and configured to apply an axial force against the biasing surface of the third ring at about a radial location that substantially radially corresponds to a radial center of the second metal seal face.

In another embodiment, a sealing system for a drill bit including a shaft region and a rotating cone comprises: a first annular gland defined in the rotating cone; a first ring mounted in the first annular gland and having a first metal seal face; a second ring mounted to the shaft region; a third ring including a second metal seal face in contact with the first metal seal face and further including a biasing surface axially opposite the second metal seal face; a second annular gland formed between the second ring and third ring; an O-ring sealing member radially compressed within the second annular gland and wherein the second gland is sized to permit axial movement of the O-ring sealing member within the second gland in response to pressure change; and an energizing structure configured to apply an axial force against the biasing surface of the third ring.

BRIEF DESCRIPTION OF THE DRAWINGS

Other features and advantages of the invention will become clear in the description which follows of several non-limiting examples, with references to the attached drawings wherein.

DETAILED DESCRIPTION OF THE DRAWINGS

FIGS. 1-4 have previously been described.

Figure 1:
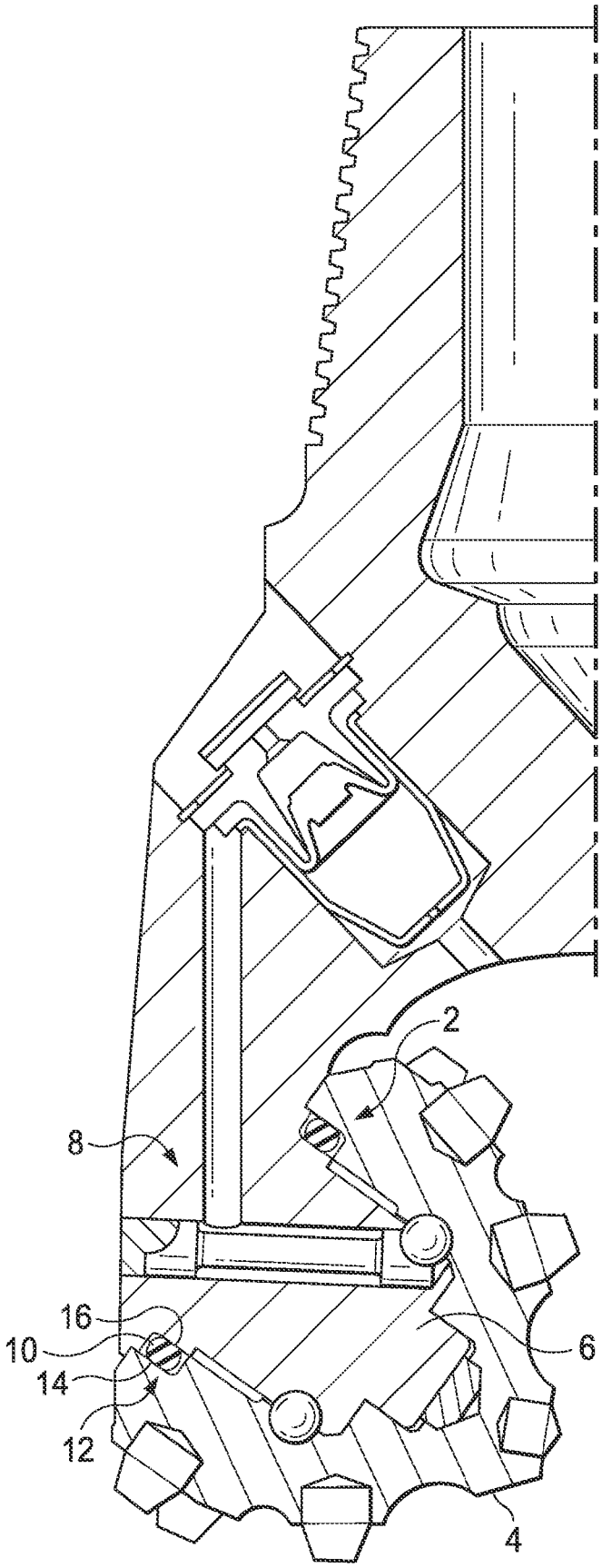
FIG. 1 (PRIOR ART)
FIG. 1 illustrates a prior art configuration for an earth boring bit with a conventional O-ring type sealing system.
Figure 2:
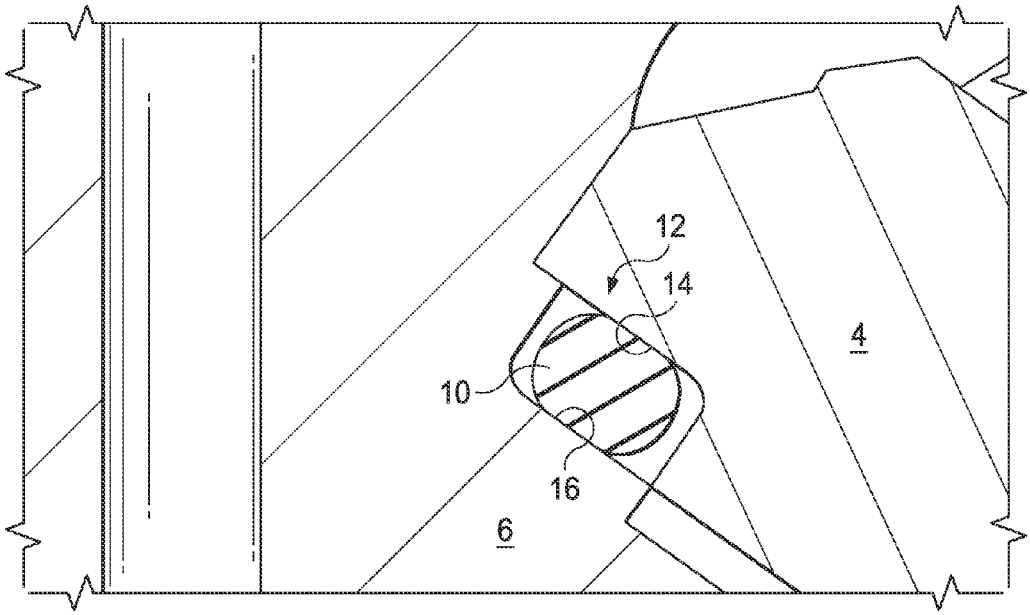
FIG. 2 (PRIOR ART)
FIG. 2 illustrates a close-up view of the prior art configuration of FIG. 1 focusing on the area of the seal.
Figure 4:
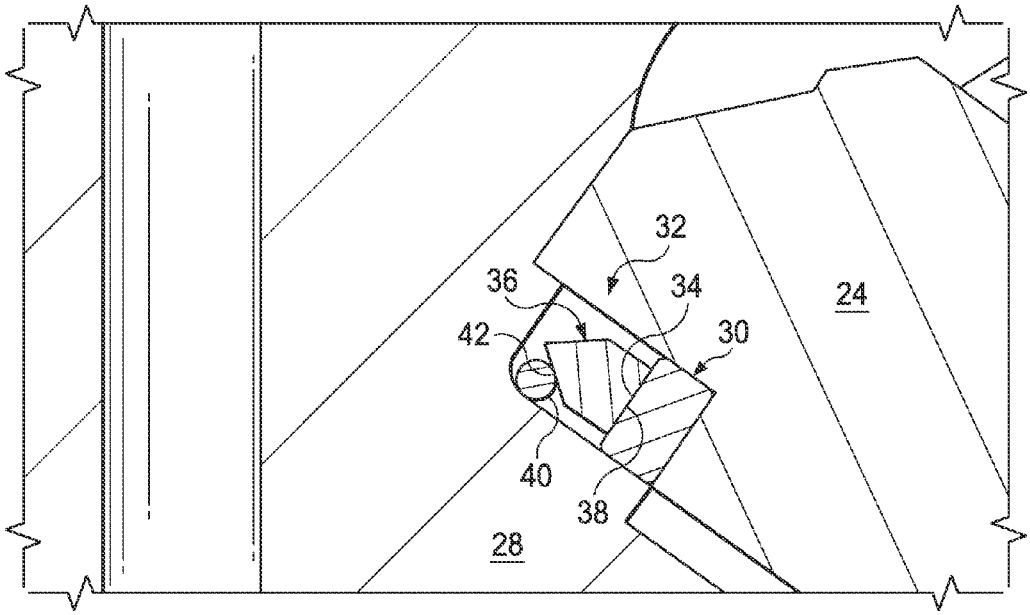
FIG. 4 (PRIOR ART)
FIG. 4 illustrates a close-up view of the prior art configuration of FIG. 3 focusing on the area of the seal.
Figure 3:
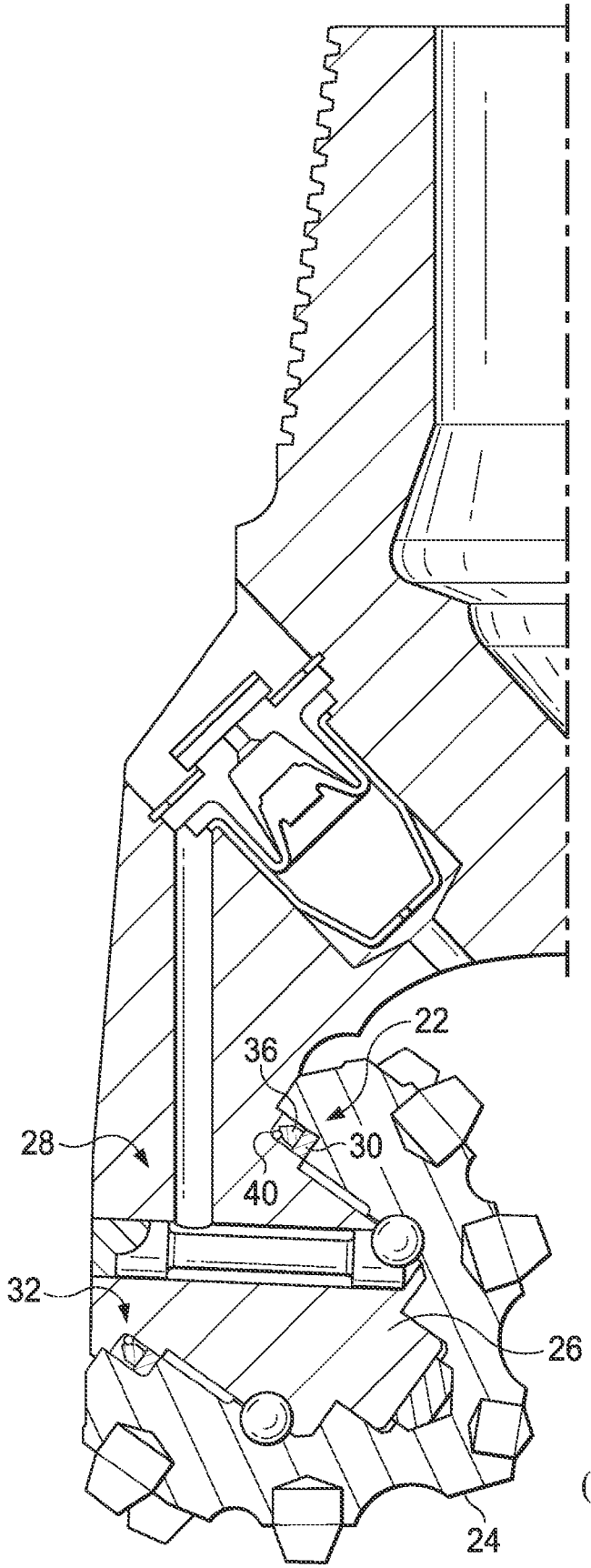
FIG. 3 (PRIOR ART)
FIG. 3 illustrates a prior art configuration for an earth boring bit with a conventional single energizer metal faced sealing system.
Figure 5A:
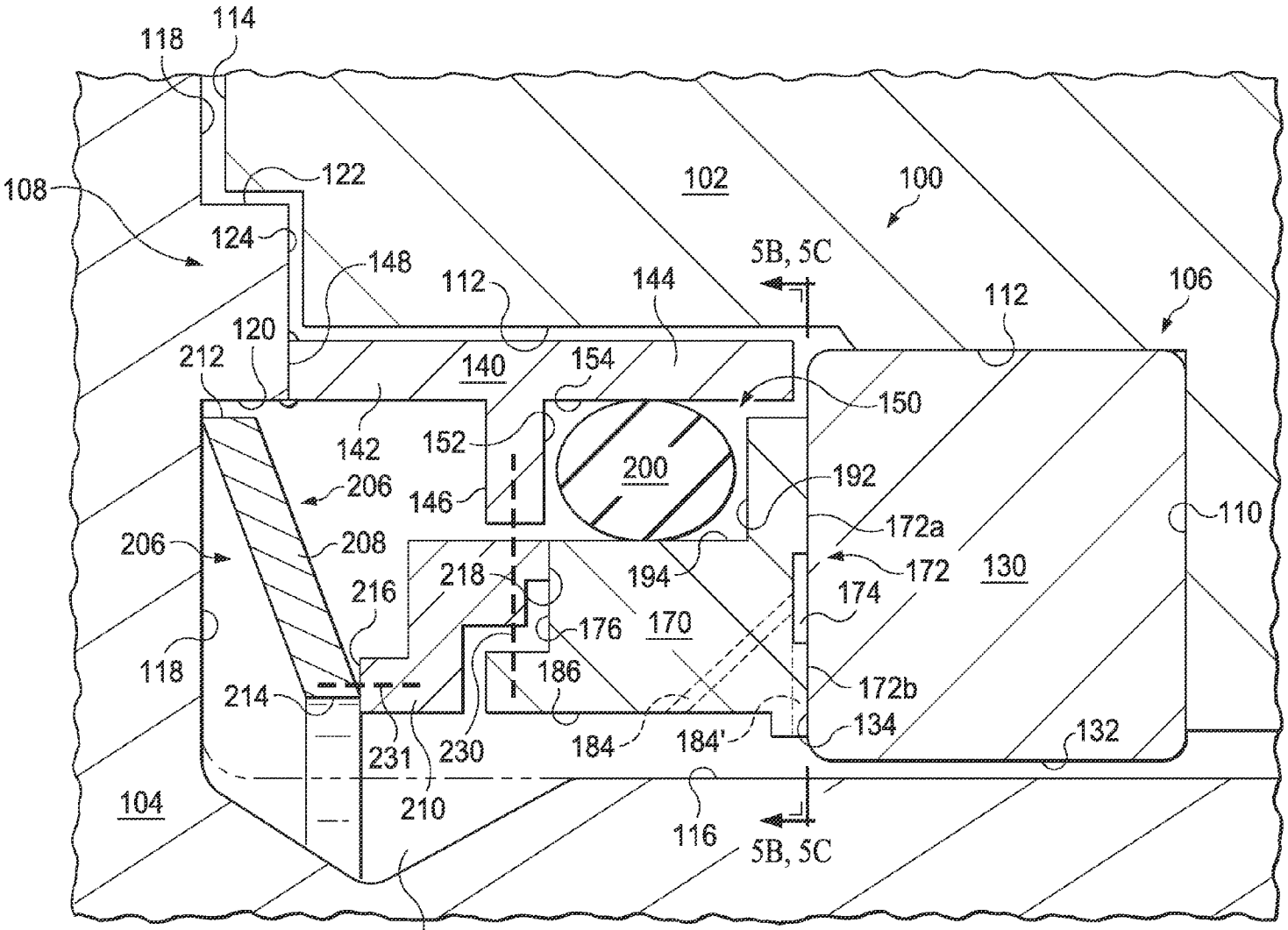
FIGS. 5A, 5B, and 5C illustrate an embodiment of a metal faced sealing system.

Reference is now made to FIG. 5A which illustrates a cross-sectional view of an embodiment of a metal faced sealing system 100. The sealing system 100 is associated with a rotating cone 102 installed on a shaft region 104. The sealing system 100 is suitable for use in any sealing application including implementations where the cone is supported for rotation using a journal bearing or a roller bearing as well known to those skilled in the art.

The sealing system 100 is provided within a gland structure 106 formed in the cone 102 adjacent a base of the shaft region 104. The gland structure 106 formed in the cone is an annular structure defined by a radial surface 110 extending outwardly into the body of the cone 102 perpendicularly away from the axis of cone rotation and a cylindrical surface 112 extending perpendicularly and rearwardly from the radial surface towards a bottom surface (base) 114 of the cone in a direction parallel to the axis of cone rotation. The shaft region 104 is defined by a cylindrical shaft surface 116 to which the cone 102 is mounted (in a manner conventional and known to those skilled in the art) and a radial surface 118 at the base of the shaft region extending outwardly from the cylindrical shaft surface 116 perpendicularly away from the axis of cone rotation. An annular projection 108 extends axially from the radial surface 118 at the base of the shaft region 104 and includes a pair of cylindrical side surfaces 120 and 122 and a radial surface 124 interconnecting the cylindrical surfaces 120 and 122 at a top of the annular projection. In this configuration, it will be noted that the annular projection 108 extends into the gland structure 106. An annular grease gland 126 is formed in the shaft region 104 where the cylindrical shaft surface 116 meets the radial surface 118. This grease gland 126 is an optional structure, and in an alternative embodiment (shown in dotted line) the cylindrical shaft surface 116 extends to the corner to meet with the radial surface 118.

The sealing system 100 further comprises a first ring 130 (having a generally square or rectangular cross-section) press fit into the first gland 106 against the radial surface 110 and cylindrical surface 112 at a corner where the surfaces 110 and 112 meet. An inner diameter of the first ring 130 defined by surface 132 is offset from the cylindrical surface 116 of the shaft region 104. The first ring 130 further includes a first metal seal face (using a radially extending surface) 134.

The sealing system 100 further comprises a second ring 140 (having a T-shaped cross-section) that includes a first leg region 142, second leg region 144 and third leg region 146. The first and second leg regions 142 and 144 extend axially away from each other and the third leg region 146. The third leg region 146 extends inwardly and radially from the first and second leg regions 142 and 144. A distal end of the first leg region 142 is mounted to the shaft region 104 (see, reference 148). More particularly, in an embodiment the distal end of the first leg region is welded to the radial surface 124 of the annular projection 108. In an alternative implementation, the annular projection 108 may be absent and the distal end of the first leg region 142 is welded to the radial surface 118 of the shaft region 104. In yet another alternative implementation, the distal end of the first leg region 142 may be welded to the surface 120 of the annular projection 108. While welding presents a preferred method for mounting the second ring 140 to the shaft region 104, other mounting means such a press-fitting the distal end in an annular slot formed in the projection 108 or surface 118 could instead be selected. Still further, the mounting of the second ring 140 may be accomplished by integrally forming the second ring with the shaft region 104.

The second and third leg regions 144 and 146 of the second ring 140 form part of a second gland 150 comprising an annular structure defined by a radial surface 152 of the third leg region 146 extending perpendicularly away from the axis of cone rotation and a cylindrical surface 154 of the second leg region 144 extending perpendicularly and frontwardly from the radial surface towards a distal end of the second leg region 144 in a direction parallel to the axis of cone rotation.

The sealing system 100 further comprises a third ring 170 (having an L-shaped cross-section) that includes a second metal seal face (using a radially extending surface) 172 including a first portion 172*a* and a second portion 172*b*. The second metal seal face 172 is positioned in sliding/sealing contact with the first metal seal face 134. The sealing contact is made between the first portion 172*a* of the second metal seal face 172 and the first metal seal face 134 of the first ring 130. Axially opposite the second metal seal face 172, the third ring 170 further includes a biasing surface 176.

Figure 5B:
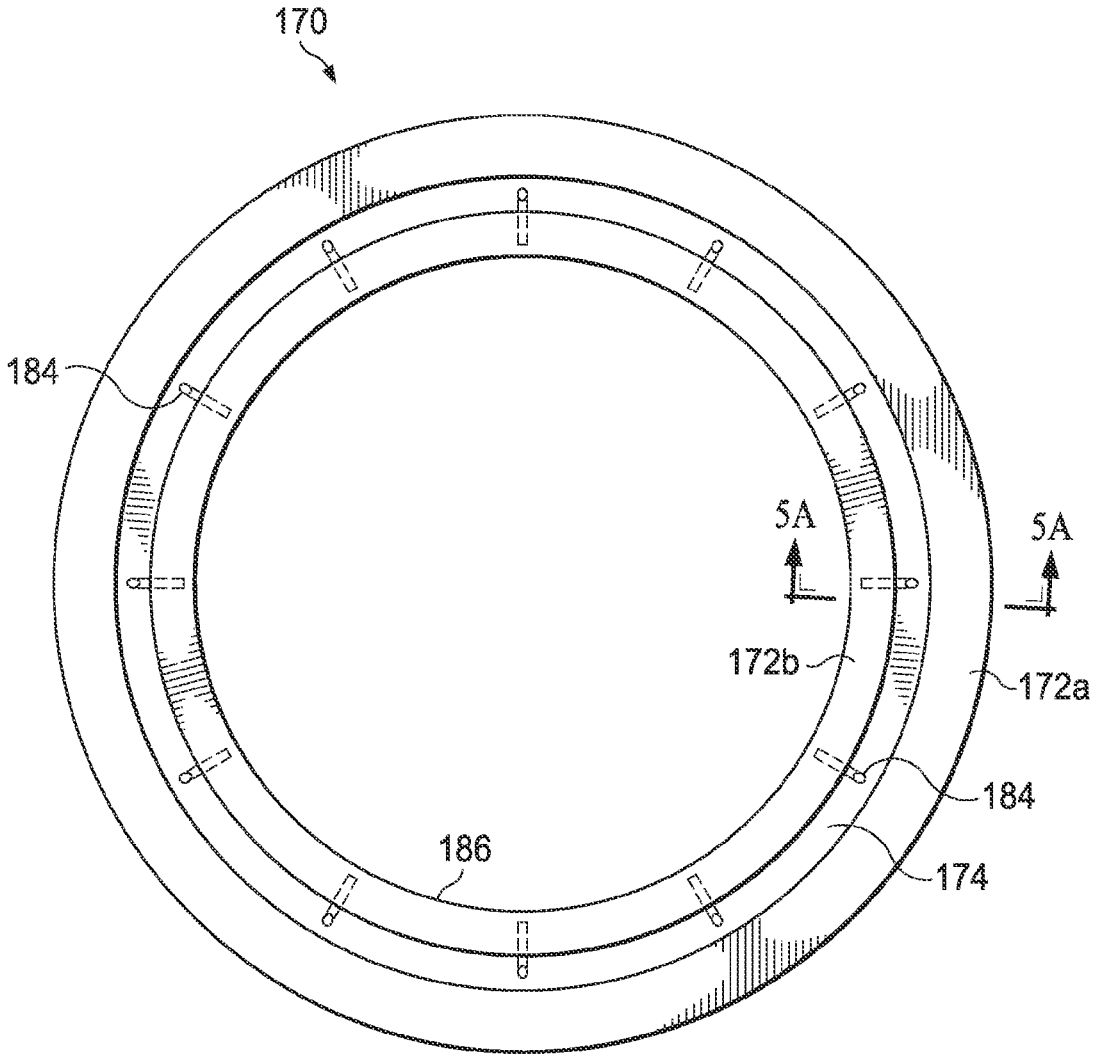

The first and second portions 172*a* and 172*b* are coaxial and are separated from each other by an annular channel 174. The annular channel 174 forms a non-contacting region of the face 172 that serves to separate the function of the first portion 172*a* from the function of the second portion 172*b*. The size (for example, width) of the channel 174 may be selected to serve the purpose of the design by adjusting the forces acting on the first and second portions 172*a* and 172*b*. A plurality of passages 184 are provided extending through the third ring 170 to connect an inner circumferential surface 186 of the third ring 170 to the annular channel 174. The plurality of passages 184 are angularly distributed about the annular channel 174. The passages 184 provide for pressure equalization between the channel 174 and the grease side of the seal at reference 186. FIG. 5B (not drawn to scale) shows the angular distribution of the passages 184 about the inner circumference 186. In this configuration, both the first portion 172*a* and the second portion 172*b* are circumferentially continuous. However, it is the portion 172*a* which is responsible for providing the sealing surface. In an illustrated embodiment, there are twelve passages 184, so that the angular offset between passages is thirty degrees. In another implementation, sixteen passages 184 may be provided. Fewer or more passages may be provided in accordance with a desired design (perhaps based on the diameter of the cone and diameter of the gland 106).

Figure 5C:
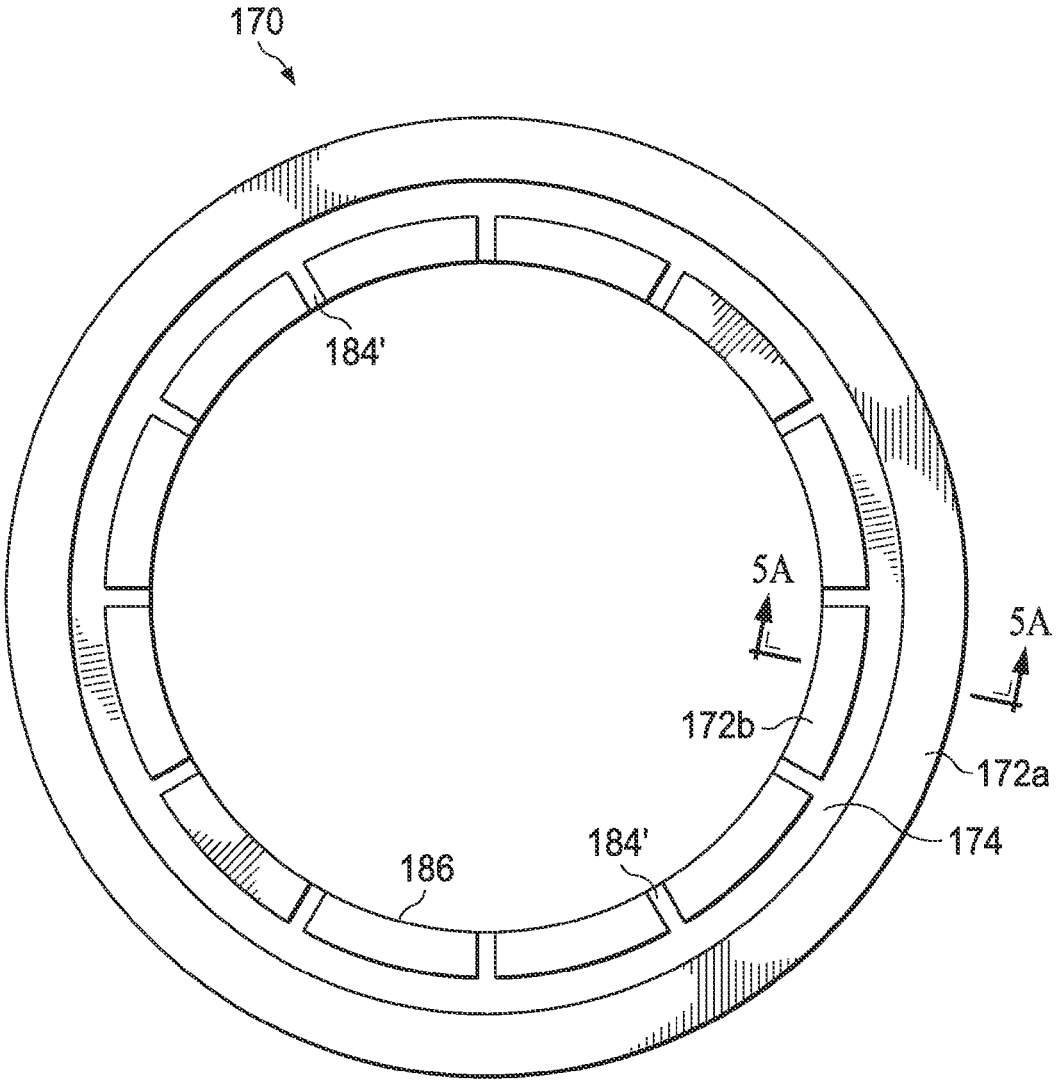

In an alternative implementation, a plurality of radially extending channels 184' are provided in the second portion 172*b* of the second metal seal face 172 to extend between the inner circumference 186 of the third ring 170 and the annular channel 174. The channels 184' provide for pressure equalization between the channel 174 and the grease side of the seal at reference 186. FIG. 5C (not drawn to scale) shows the angular distribution of the channels 184' about the inner circumference 186. The second portion 172*b* of the second metal seal face 172 is accordingly circumferentially discontinuous and thus does not participate in forming the seal (while the first portion 172*a* is circumferentially continuous and thus responsible for providing the sliding sealing surface). In the illustrated embodiment, there are twelve channels 184', so that the angular offset between channels is thirty degrees. In another implementation, sixteen channels 184' may be provided. Fewer or more channels may be provided in accordance with a desired design (perhaps based on the diameter of the cone and diameter of the gland 106).

The L-shape of the third ring 170 further assists in defining the third gland 150 by presenting an annular structure defined by a radial surface 192 extending outwardly perpendicularly away from the axis of cone rotation and a cylindrical surface 194 extending perpendicularly and rearwardly from the radial surface toward the surface 176 parallel to the axis of cone rotation.

An O-ring sealing member 200 (for example, with a circular cross-section) is inserted within the second gland 150 and radially compressed between the cylindrical surface 154 of the second ring 140 and the cylindrical surface 194 of the third ring 170. In a preferred implementation, there is sufficient axial room in the second gland 150 (between surface 152 and 192) to permit some axial movement of the O-ring sealing member 200 within the second gland in response to pressure changes. In an alternative implementation, the O-ring sealing member 200 may further be axially compressed between the radial surface 152 of the second ring 140 and the radial surface 192 of the third ring 170.

The radial compression of the O-ring sealing member 200 between the surfaces 154 and 194 couples the third ring 170 to the second ring 140. The compressed O-ring sealing member 200 accordingly forms a static seal between the grease side and exterior (for example, mud) side of the sealing system 100. The sliding seal between the grease side and exterior side is provided by the opposed first and second metal seal faces 134 and 172, respectively.

An energizing structure 206 is installed within the first gland 106 between the third ring 170 and the shaft region 104. The energizing structure 206 engages the radial surface 118 at the base of the shaft region 104 and further engages the biasing surface 176 of the third ring 170. Thus, the energizing structure 206 is compressed between the radial surface 118 and the biasing surface 176. In this configuration, the energizing structure 206 functions to apply an axially directed force against the third ring 170 so as to maintain sliding/sealing contact between the first metal seal face 134 of the first ring 130 and the second metal seal face 172 of the third ring 170.

In a preferred implementation, the energizing structure 206 comprises a Belleville spring member 208 (or any suitable conical spring washer device) and a force transfer ring 210. The Belleville spring member 208 includes an outer peripheral edge 212 which engages the radial surface 118 at the base of the shaft region 104. An inner peripheral edge 214 of the Belleville spring member 208 engages a rear surface 216 of the force transfer ring 210. An opposite front surface 218 of the force transfer ring 210 engages the biasing surface 176 of the third ring 170. It will be noted that the force transfer ring 210 is configured to transfer the radial application point of the axially directed biasing force from a relatively smaller radial position at the inner peripheral edge 214 of the Belleville spring member 208 to relatively larger radial position at the biasing surface 176. Importantly, this relatively larger radial position of the axially applied biasing force on the third ring is radially located at approximately the radial center of the second metal seal face 172 of the third ring so as to equalize the force applied by the first portion 172*a* and a second portion 172*b* of the second metal seal face 172 against the first metal seal face 134, and more importantly ensure sufficient force applied by the first portion 172*a* to maintain the sealed relationship with the first metal seal face 134.

The second portion 172*b* of the second metal seal face 172 does not provide for sealing (due to the presence of passages 184 or channels 184' and annular channel 174), but instead functions as a self-aligning guiding face for the sliding seal. The third ring 170 is somewhat flexible due to its short axial length. Through the careful arrangement of hydraulic forces on the seal ring and in response to the circumferentially distributed force supplied by the energizing structure 206 against the third ring 170, the sliding seal becomes self-aligning to any tilting (i.e., waviness) present on the first metal seal face 134 as a result of press-fitting the first ring 130 with the first gland 106. The second portion 172*b* is preloaded by the spring member 208 and pressure loads. The contact force will vary as needed to ensure that the portion 172*b* remains in contact with the face 134 in spite of any circumferential variation in surface face tilting (i.e., waviness of the face 134 resulting, for example, from the press-fitting of the ring 130). This ensures that first portion 172*a* maintains a parallel face sealing contact with the face 134.

With respect to applying drive torque, a number of technical implementations may be utilized. In a preferred embodiment, a radially extending drive connection (schematically shown at reference 230) is provided to interconnect the second ring 140, third ring 170 and transfer ring 210. The radially extending drive connection 230 may take the form of a plurality of circumferentially spaced drive pins which radially extend through passages formed in second ring 140, third ring 170 and transfer ring 210.

As a further alternative to applying drive torque, an axially extending drive connection (schematically shown at reference 231) is provided to interconnect the spring member 208 to the transfer ring 210. For example, a plurality of circumferentially spaced notches and corresponding protrusions may be formed in the inner edge 214 and surface 216 to provide for an engagement. Likewise, the engagement of the transfer ring 210 and third ring 170 may be made by a plurality of circumferentially spaced notches and corresponding protrusions so as to ensure the drive torque is transferred to the third ring 170. And furthermore, likewise, the engagement of the spring surface 212 and shaft radial surface 118 may be made by use of a plurality of circumferentially spaced notches and corresponding protrusions so as to ensure the drive torque is transferred to the spring 208 from the shaft 116.

Figure 5D:
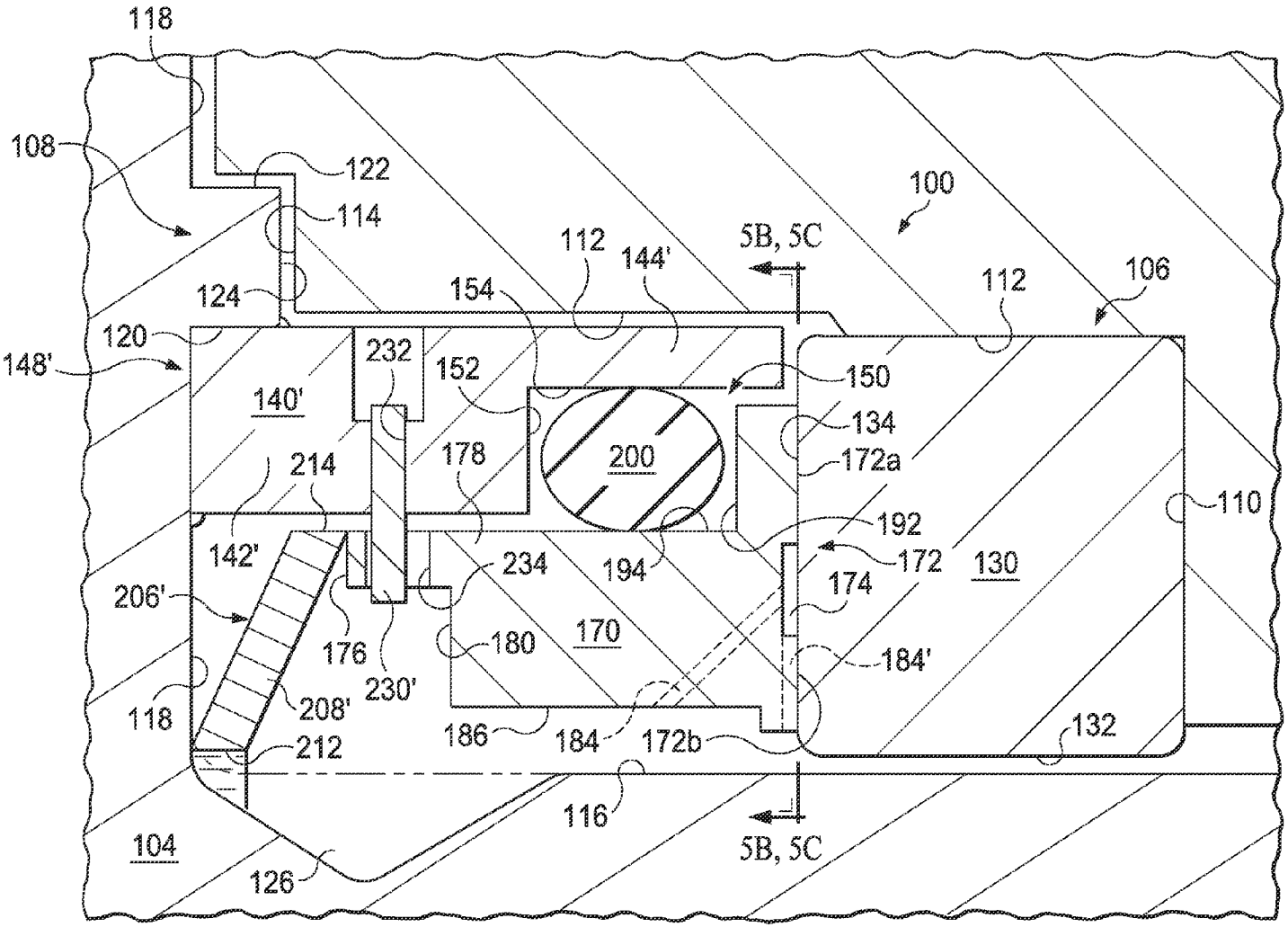
FIG. 5D illustrates an embodiment of a metal faced sealing system.

Reference is now made to FIG. 5D which illustrates a cross-sectional view of an embodiment of a metal faced sealing system 100. The embodiment of FIG. 5D is similar to the embodiment of FIG. 5A and like reference numbers refer to like or similar parts for which no further discussion will be provided. With respect to those parts, reference is made to the description of FIG. 5A. The embodiment of FIG. 5D differs from the embodiment of FIG. 5A primarily in the configuration of the second ring 140' and the energizing structure 206'.

Turning first to the second ring 140', the second ring 140' has an L-shaped cross-section including a body region 142' and an axially extending leg region 144'. The body region 142' is mounted to the shaft region 104 (see, reference 148'). More particularly, in an embodiment the body region 142' is welded to the cylindrical surface 120 of the annular projection 108. Additionally, or alternatively, the body region 142' is welded to the radial surface 118 of the shaft region 104. In yet another alternative implementation, the body region 142' is press-fit against the cylindrical surface 120 of the annular projection 108, or press-fit into an annular slot formed in the surface 118. Still further, the mounting of the second ring 140' may be accomplished by integrally forming the second ring with the shaft region 104.

In the illustrated embodiment, the biasing surface 176 is provided at the distal end of an axially extending biasing projection member 178. Also axially opposite the second metal seal face 172, the third ring 170 further includes a rear surface 180.

With respect to the energizing structure 206', the energizing structure 206' is installed within the first gland 106 between the third ring 170 and the shaft region 104. The energizing structure 206' engages the radial surface 118 at the base of the shaft region 104 and further engages the biasing surface 176 of the third ring 170. Thus, the energizing structure 206' is compressed between the radial surface 118 and the biasing surface 176. In this configuration, the energizing structure 206' functions to apply an axially directed force against the third ring 170 so as to maintain sliding/sealing contact between the first metal seal face 134 of the first ring 130 and the second metal seal face 172 of the third ring 170.

In a preferred implementation, the energizing structure 206' comprises a Belleville spring member 208' (or any suitable conical spring washer device). The Belleville spring member 208' includes an inner peripheral edge 212 which engages the radial surface 118 at the base of the shaft region 104. An outer peripheral edge 214 of the Belleville spring member 208' engages the biasing surface 176 of the third ring 170. It will be noted that the orientation of the Belleville spring member 208' is opposite that of the member 208 in FIG. 5A. With this configuration, the transfer ring 210 is not required and the Bellevelle spring member 208' axially applies force to the biasing surface 176 at a relatively larger radial position that is radially located at approximately the radial center of the third ring 170 so as to equalize the force applied by the first portion 172*a* and a second portion 172*b* of the second metal seal face 172 against the first metal seal face 134, and more importantly ensure sufficient force applied by the first portion 172*a* to maintain the sealed relationship with the first metal seal face 134. Again, the axial force is applied to the biasing surface 176 at a radial position which substantially radially corresponds to a radial center of the second metal seal face 172.

With respect to applying drive torque, a number of technical implementations may be utilized. In a preferred embodiment, a plurality of radially extending drive pins 230' are provided to interconnect the second ring 140' and the third ring 170. The radially extending drive pins 230' are circumferentially spaced about the rings and radially extend through first passages 232 formed in second ring 140' and correspondingly aligned second passages 234 in the third ring 170. The pins 230' are press-fit (or otherwise secured in a sealed manner) within the passages 232. The passages 234 are configured in the form of an axially extending slot which loosely receives the pins 230' so as to permit an axial sliding of the third ring 170 relative to the second ring 140'.

Figure 5E:
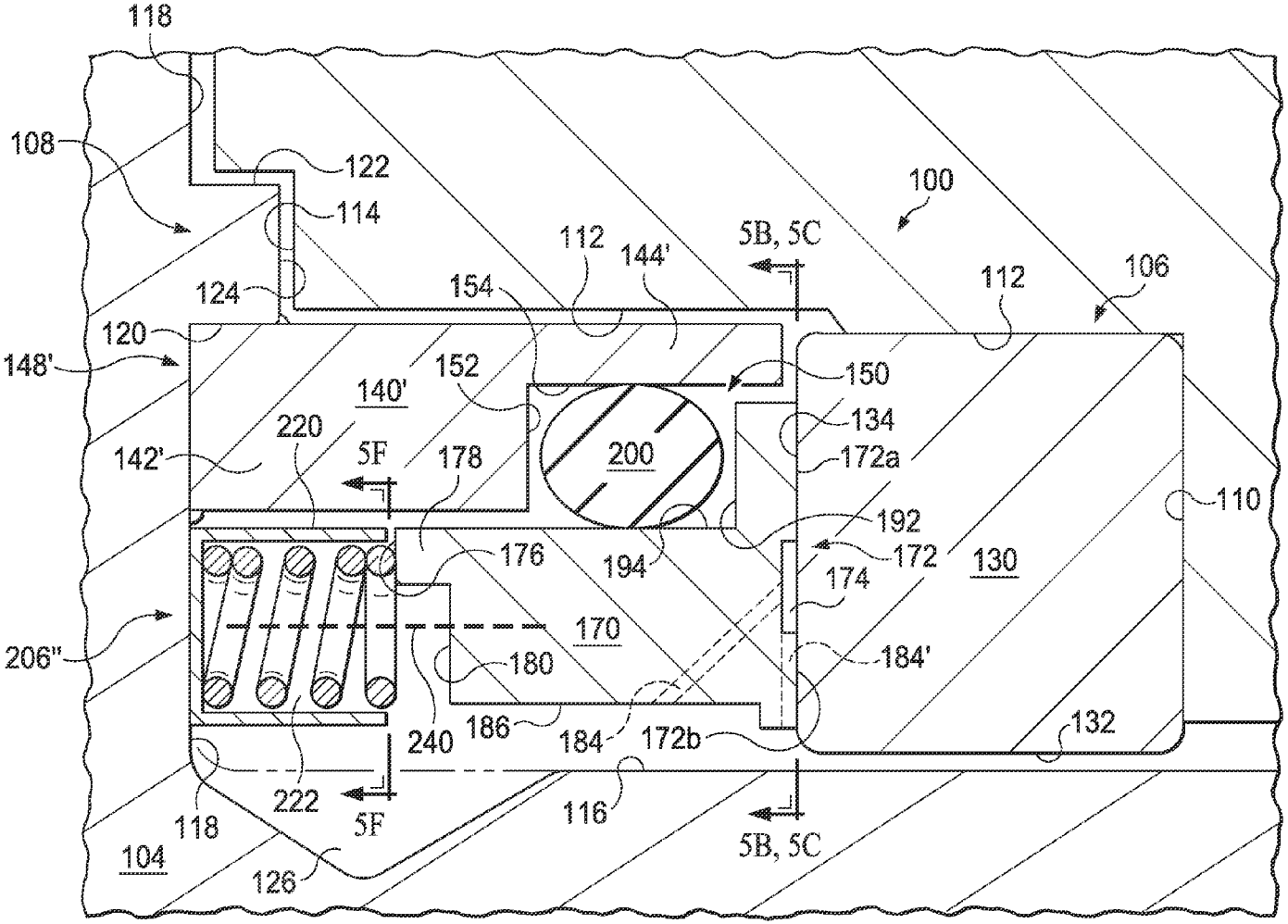
FIGS. 5E and 5F illustrate an embodiment of a metal faced sealing system.

Reference is now made to FIG. 5E which illustrates a cross-sectional view of an embodiment of a metal faced sealing system 100. The embodiment of FIG. 5E is similar to the embodiments of FIGS. 5A and 5D and like reference numbers refer to like or similar parts for which no further discussion will be provided. With respect to those parts, reference is made to the description of FIGS. 5A and 5D. The embodiment of FIG. 5E differs from the embodiments of FIGS. 5A and 5D primarily in the configuration of the energizing structure 206".

Figure 5F:
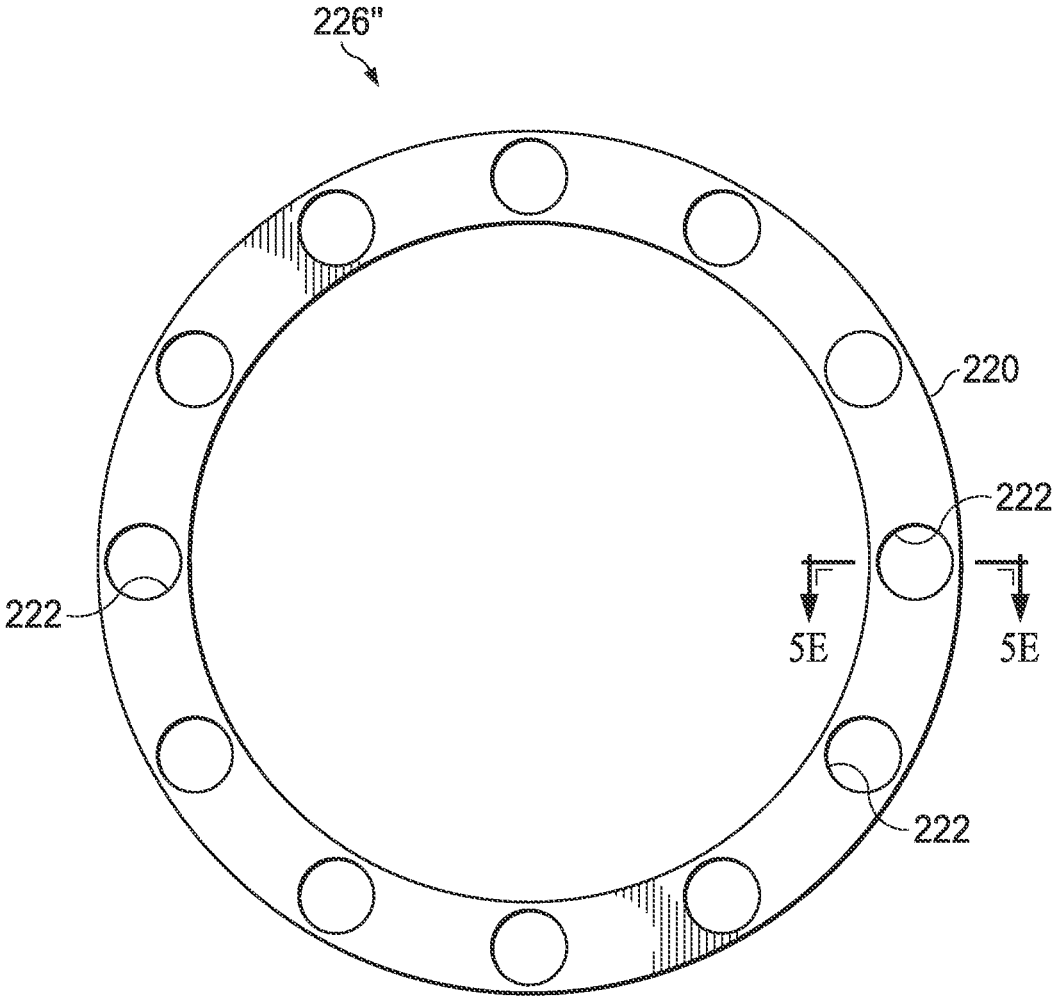

The energizing structure 206" comprises a ring housing 220 installed in the gland 106 adjacent the radial surface 118 at the base of the shaft region 104. The ring housing 220 includes a plurality of axially extending apertures 222 evenly distributed circumferentially around the ring housing (see, FIG. 5F, not drawn to scale). In the illustrated embodiment, there are twelve apertures 222, so that the angular offset between apertures is thirty degrees. In another implementation, sixteen apertures 222 may be provided. Fewer or more apertures may be provided in accordance with a desired design (perhaps based on the diameter of the cone and diameter of the gland 106).

A coil spring 224 is installed in each aperture 222. A first end of the coil spring 224 engages a floor of the aperture 222. A second end of the coil spring 224 engages the biasing surface 176 of the third ring 170. Thus, each coil spring 210 is compressed between the floor of the aperture 222 and the biasing surface 176. In this configuration, the coil spring 224 functions to apply an axially directed force against the third ring 170 so as to maintain sliding/sealing contact between the first metal seal face 134 of the first ring 130 and the second metal seal face 172 of the third ring 170. As with the Bellevelle spring member 208', the coil spring 224 axially applies force to the biasing surface 176 at a relatively larger radial position located at approximately the radial center of the third ring 170 so as to equalize the force applied by the first portion 172*a* and a second portion 172*b* of the second metal seal face 172 against the first metal seal face 134, and more importantly ensure sufficient force applied by the first portion 172*a* to maintain the sealed relationship with the first metal seal face 134. Again, the axial force is applied to the biasing surface 176 at a radial position which substantially radially corresponds to a radial center of the second metal seal face 172.

With respect to applying drive torque, a number of technical implementations may be utilized. In one embodiment, an axially extending drive connection (schematically shown at reference 240) is provided to interconnect the ring housing 220 and the third ring 170. The axially extending drive connection 240 may take the form of a plurality of circumferentially spaced drive pins which axially extend through passages formed in ring housing 220 and third ring 170. In another implementation, a radially extending drive connection (see, for example, FIGS. 5A and 5D) may be used to apply drive torque.

Although the biasing surface 176 in FIGS. 5D and 5E is illustrated as a separate surface from the rear surface 180 of the third ring 170, it will be understood that the biasing surface 176 and rear surface 180 may, in an alternative embodiment, comprise a same surface of the third ring 170 against which the energizing structure applies the axially directed force to maintain the sealing relationship between the first and second metal seal faces 134 and 172, respectively.

While a coil spring 224 is illustrated to reside in aperture 220 and supply the biasing axial force against the third ring 170, it will be understood that the aperture could take on shapes other than a circular hole and that the coil spring 224 could alternatively comprise other spring or energizing structures known to those skilled in the art (including, for example, a leaf spring or elastic member) that are inserted within the aperture.

Figure 6:
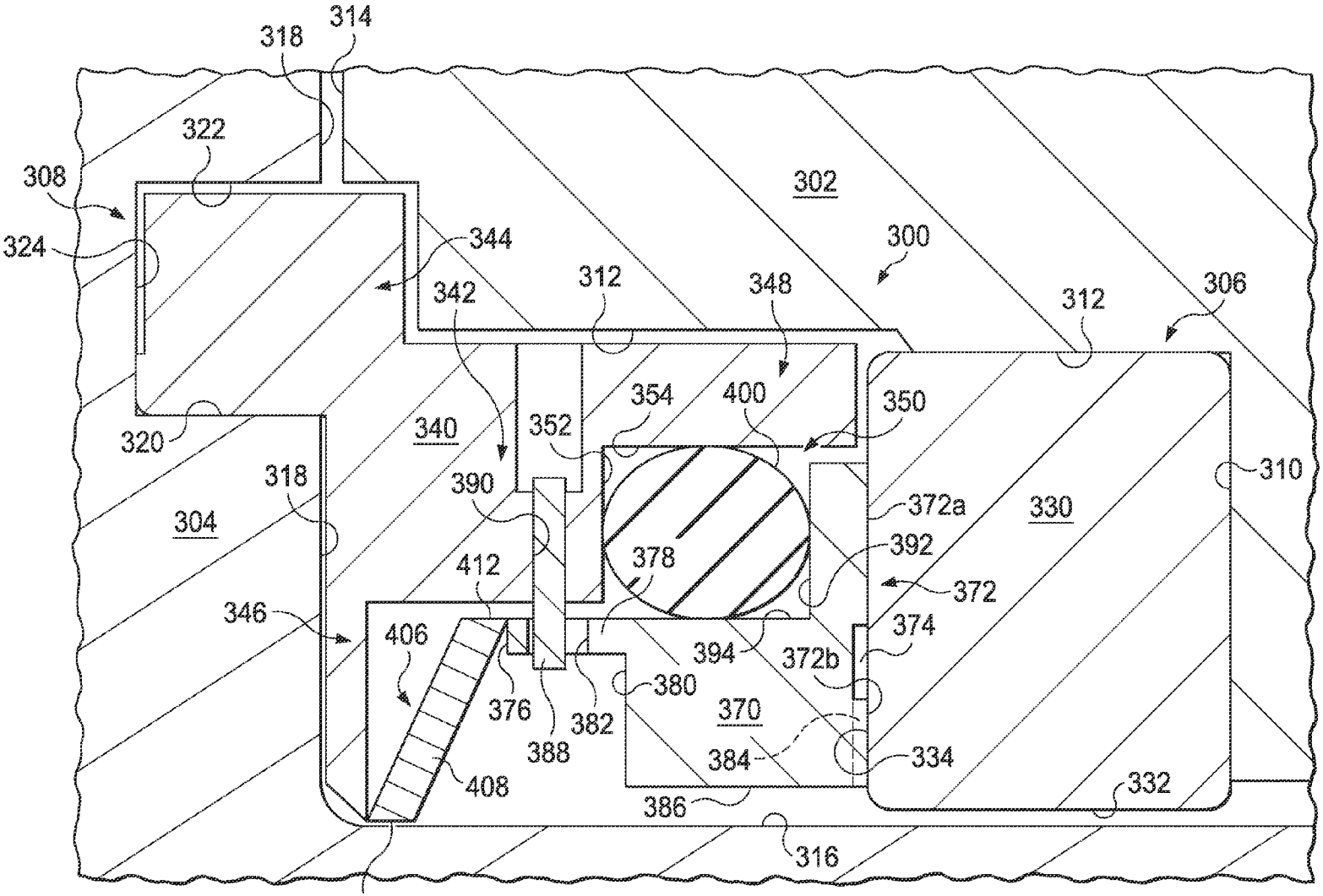
FIG. 6 illustrates an embodiment of a metal faced sealing system.

Reference is now made to FIG. 6 which illustrates a cross-sectional view of an embodiment of a metal faced sealing system 300. The sealing system 300 is associated with a rotating cone 302 installed on a shaft region 304. The sealing system 300 is suitable for use in any sealing application including implementations where the cone is supported for rotation using a journal bearing or a roller bearing as well known to those skilled in the art.

The sealing system 300 is provided within a gland structure formed in the cone 302 and at a base of the shaft region 304. The gland structure includes a first gland 306 formed in the cone and a second gland 308 formed in the base of the shaft region 304. The first gland 306 is an annular structure defined by a radial surface 310 extending outwardly into the body of the cone 302 perpendicularly away from the axis of cone rotation and a cylindrical surface 312 extending perpendicularly and rearwardly from the radial surface towards a bottom surface (base) 314 of the cone in a direction parallel to the axis of cone rotation. The shaft region 304 is defined by a cylindrical shaft surface 316 to which the cone 302 is mounted (in a manner conventional and known to those skilled in the art) and a radial surface 318 at the base of the shaft region extending outwardly from the cylindrical journal surface 316 perpendicularly away from the axis of cone rotation. The second gland 308 is an annular channel-like structure defined in the radial surface 318 at the base of the shaft region 304 by a pair of cylindrical (channel side) surfaces 320 and 322 and a radial (channel bottom) surface 324 interconnecting the cylindrical surfaces 320 and 322 at a bottom of the annular structure. In this configuration, it will be noted that the second gland opens into the first gland.

The sealing system 300 further comprises a first ring 330 (having a generally square or rectangular cross-section) press fit into the first gland 306 against the radial surface 310 and cylindrical surface 312 at a corner where the surfaces 310 and 312 meet. An inner diameter of the first ring 330 defined by surface 332 is offset from the cylindrical surface 316 of the shaft region 304. The first ring 330 further includes a first metal seal face (using a radially extending surface) 334.

The sealing system 300 further comprises a second ring 340 (having an irregular cross-section) forming a housing member that includes a central body region 342, a rear region 344 extending rearwardly and axially from the central body region, a flange region 346 extending inwardly and radially from the central body region and a front region 348 extending frontwardly and axially from the central body region. The rear region 344 of the second ring 340 is press fit into the second gland 308 against the radial surface 324 and cylindrical surface 320 at a corner where the surfaces 324 and 320 meet. The front region 348 of the second ring 340 forms part of a third gland 350 comprising an annular structure defined by a radial surface 352 extending outwardly into the front region 348 perpendicularly away from the axis of cone rotation and a cylindrical surface 354 extending perpendicularly and frontwardly from the radial surface towards an end of the second ring 348 in a direction parallel to the axis of cone rotation.

The flange region 346 extends radially inwardly from the central body region 342 to define a seat for a biasing apparatus to be described in more detail below.

The sealing system 300 further comprises a third ring 370 (having an L-shaped cross-section) that includes a second metal seal face (using a radially extending surface) 372 including a first portion 372*a* and a second portion 372*b*. The first and second portions 372*a* and 372*b* are coaxial and are separated from each other by an annular channel 374. The annular channel 374 forms a non-contacting region of the seal face that serves to separate the functions of first portion 372*a* and second portion 372*b*. The width of channel 374 is selected to ensure improved contact by the first portion 372*a*. A plurality of radially extending channels 384 are provided in the second portion 372*b* of the second metal seal face 372 to extend between an inner circumference 386 of the third ring 370 and the annular channel 374. The channels 384 support provision of pressure equalization between the channel 374 and the grease side of the seal at reference 386. Pressure equalization is desired so that the second portion 372*b* will function as a bearing surface (not a sealing surface) while the first portion 372*a* functions as a sealing surface (having a pressure differential). Reference may be made to FIG. 5C which illustrates an angular distribution of the channels 184 like the channels 384. The second portion 372*b* of the second metal seal face 372 is accordingly circumferentially discontinuous and thus does not participate in forming the seal (while the first portion 372*a* is circumferentially continuous and thus responsible for providing the sliding sealing surface).

The second metal seal face 372 is positioned in sliding/sealing contact with the first metal seal face 334. The sealing contact is made between the first portion 372*a* of the second metal seal face 372 and the first metal seal face 334 of the first ring 330. Axially opposite the second metal seal face 372, the third ring 370 further includes a biasing surface 376. In the illustrated embodiment, the biasing surface 376 is provided at the distal end of a radially extending biasing projection member 378. Also axially opposite the second metal seal face 372, the third ring 370 further includes a rear surface 380.

The third ring 370 further includes a plurality of axially and radially extending first apertures 382 (for example, forming in the shape of axially extending through slots) evenly distributed circumferentially around the biasing projection member 378. The central body region 342 of the second ring 340 includes a corresponding plurality of radially extending second apertures 390 which are aligned with the first apertures 382. A drive pin 388 passes through correspondingly aligned first and second apertures. The drive pins 388 collectively function to connect the third ring 370 to the second ring 340 for the application of drive torque. As the second ring 340 is press-fit within the second gland 308, the drive pin 388 attachment of the third ring 370 to the second ring ensures that the third ring will not rotate with the first ring 330 when the cone 302 is rotated. In the preferred implementation, the drive pin 388 is press-fit within aperture 382 and loosely fit for axial sliding within aperture 390.

The L-shape of the third ring 370 further assists in defining the third gland 350 by presenting an annular structure defined by a radial surface 392 extending outwardly perpendicularly away from the axis of cone rotation and a cylindrical surface 394 extending perpendicularly and rearwardly from the radial surface toward the surface 376 parallel to the axis of cone rotation.

An O-ring sealing member 400 (for example, with a circular cross-section) is inserted within the third gland 350 and radially compressed between the cylindrical surface 354 of the second ring 340 and the cylindrical surface 394 of the third ring 370. The O-ring sealing member 400 may further be axially compressed between the radial surface 352 of the second ring 340 and the radial surface 392 of the third ring 370. Because the second and third rings 340 and 370, respectively, are attached to each other through the drive pins 388, the compressed O-ring sealing member 400 forms a static seal between the grease side and exterior (for example, mud) side of the sealing system 300. The sliding seal between the grease side and exterior side is provided by the opposed first and second metal seal faces 334 and 372, respectively.

An energizing structure 406 is installed within the first gland 306 between the third ring 370 and seat formed by the flange region 346 of the second ring 340. The energizing structure 406 engages the radial surface of the flange region 346 and further engages the biasing surface 376 of the third ring 370. Thus, the energizing structure 406 is compressed between the second ring 340 and the biasing surface 176. In this configuration, the energizing structure 406 functions to apply an axially directed force against the third ring 370 so as to maintain sliding/sealing contact between the first metal seal face 334 of the first ring 330 and the second metal seal face 372 of the third ring 370.

In a preferred implementation, the energizing structure 406 comprises a Belleville spring member 408 (or any suitable conical spring washer device). The Belleville spring member 408 includes an outer peripheral edge 412 which engages the biasing surface 376 and an inner peripheral edge 414 which engages the flange region 346. The Belleville spring member 408 accordingly applies an axially directed force with a radial position located at approximately the radial center of the second metal seal face 372 of the third ring so as to equalize the force applied by the first portion 372*a* and a second portion 372*b* of the second metal seal face 372 against the first metal seal face 334, and more importantly ensure sufficient force applied by the first portion 372*a* to maintain the sealed relationship with the first metal seal face 334.

Although the biasing surface 376 is illustrated as a separate surface from the rear surface 380 of the third ring 370, it will be understood that the biasing surface 376 and rear surface 380 may, in an alternative embodiment, comprise a same surface of the third ring 370 against which the spring member 408 applies the axially directed force to maintain the sealing relationship between the first and second metal seal faces 334 and 372, respectively.

The second portion 372*b* of the second metal seal face 372 does not provide for sealing (due to the presence of radially extending channels 384 and annular channel 374), but instead functions as a self-aligning guiding face for the sliding seal. The third ring 370 is somewhat flexible due to its short axial length. Through the careful arrangement of hydraulic forces on the seal ring and in response to the circumferentially distributed force supplied by the spring member 408 against the third ring 370, the sliding seal becomes self-aligning to any tilting (i.e., waviness) present on the first metal seal face 334 as a result of press-fitting the first ring 330 with the first gland 306. The second portion 372*b* is pre-loaded by the spring member 408 and pressure caused loads. The contact force will vary as needed to ensure that second portion 372*b* maintains contact with the surface 334 in spite of any circumferential variation due to face tilt (i.e., waviness of surface 334 as a result of the press fit). This ensures that first portion 372*a* is in sealing contact with surface 334 (i.e., the surfaces maintain a parallel face contact).

In the illustrated embodiment of FIG. 6, each of the apertures 382 and 390 are shown passing completely through the third ring 370 and second ring 340, respectively. In an alternative embodiment, one or the other of the apertures 382 and 390 may comprise a blind opening.

While FIG. 6 illustrates the mounting of the second ring to shaft region 304 using the second gland 308, it will be understood that in an alternative embodiment the ring 340 may comprise the regions 342, 346 and 348 with region 342 mounted to the shaft region 304 using any suitable mounting means (including, for example, a welded attachment). See, for example, FIGS. 5A, 5D and 5E. Likewise, the first ring 330 may alternatively be mounted within the first gland 306 using any suitable mounting means (including, for example, a welded attachment).

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A sealing system for a drill bit including a shaft region and a rotating cone, comprising:

a first annular gland defined in the rotating cone;

a first ring mounted in the first annular gland and having a first metal seal face;

a second ring mounted at a base of the shaft region;

a third ring including a metal face comprising a second metal seal face in contact with the first metal seal face and a coaxially arranged surface portion separated from the second metal seal face by an annular channel, the third ring further including a biasing surface axially opposite the second metal seal face; and an energizing structure mounted adjacent the second ring and configured to apply an axial force against the biasing surface of the third ring at a radial location that substantially radially corresponds to a radial center of the metal face.

2. The sealing system of claim 1, wherein the shaft region includes a cylindrical surface and the base includes a radial surface extending perpendicular to the cylindrical surface, and wherein the second ring is mounted to the radial surface.

3. The sealing system of claim 1, wherein the shaft region includes a cylindrical surface and the base includes a radial surface extending perpendicular from the cylindrical surface, and further including an annular projection extending from the radial surface, and wherein the second ring is mounted to the annular projection.

4. The sealing system of claim 1, wherein the shaft region includes a cylindrical surface and the base includes a radial surface extending perpendicular from the cylindrical surface, and further including an annular gland formed in the radial surface, and wherein the second ring is mounted within the annular gland.

5. The sealing system of claim 1, further comprising:

a second annular gland formed between the second ring and third ring; and an O-ring sealing member compressed within the second annular gland.

6. The sealing system of claim 5, wherein the O-ring sealing member is radially compressed within the second gland between a first cylindrical surface of the second ring and a second cylindrical surface of the third ring, and wherein the second gland is sized between a first radial surface of the second ring and a second radial surface of the third ring to permit axial movement of the O-ring sealing member within the second gland in response to pressure change.

7. The sealing system of claim 1, wherein the shaft region includes a cylindrical surface and the base includes a radial surface extending perpendicular from the cylindrical surface, and wherein the energizing structure comprises a Belleville spring member including an inner edge which engages the radial surface and an outer edge which engages the biasing surface of the third ring.

8. The sealing system of claim 1, wherein the shaft region includes a cylindrical surface and the base includes a radial surface extending perpendicular from the cylindrical surface, and wherein the energizing structure comprises a Belleville spring member including an outer edge which engages the radial surface and an inner edge which engages a force transfer ring, said farce transfer ring configured to radially transfer the axial force for application to the biasing surface of the third ring.

9. The sealing system of claim 1, wherein the second ring includes a radially inwardly extending flange, and wherein the energizing structure comprises a Belleville spring member including an inner edge which engages the radially inwardly extending flange and an outer edge which engages the biasing surface of the third ring.

10. The sealing system of claim 1, wherein the second metal seal face is in sliding and sealing configuration with the first metal seal face on the first ring.

11. The sealing system of claim 10, wherein the coaxially arranged surface portion includes a plurality of radially extending channels connected to the annular channel.

12. The sealing system of claim 10, further including a plurality of radially extending passages passing through the third ring and connected to the annular channel.

13. The sealing system of claim 1, further comprising at least one radially extending drive pin interconnecting the second ring to the third ring.

14. The sealing system of claim 1, wherein the energizing structure comprises a plurality of spring members configured to apply axial force against the biasing surface of the third ring.

15. The sealing system of claim 14, wherein each spring member is a coiled spring.

16. The sealing system of claim 15, further comprising at least one axially extending drive mechanism coupled to the third ring.

17. A sealing system for a drill bit including a shaft region and a rotating cone, comprising:

a first annular gland defined in the rotating cone;

a first ring mounted in the first annular gland and having a first metal seal face;

a second ring mounted to a base of the shaft region and having a radial surface;

a third ring including a second metal seal face in contact with the first metal seal face and further including a biasing surface axially opposite the second metal seal face;

a second annular gland formed between the second ring and third ring, wherein the second annular gland is partially defined by the radial surface of the second ring;

an O-ring sealing member radially compressed within the second annular gland and wherein the second annular gland is sized to permit axial movement of the O-ring sealing member within the second annular gland in response to pressure change; and an energizing structure configured to apply an axial force against the biasing surface of the third ring.

18. The sealing system of claim 17, wherein the shaft region includes a cylindrical surface and the base includes a radial surface extending perpendicular to the cylindrical surface, and wherein the second ring is mounted to the radial surface.

19. The sealing system of claim 17, wherein the shaft region includes a cylindrical surface and the base includes a radial surface extending perpendicular from the cylindrical surface, and further including an annular projection extending from the radial surface, and wherein the second ring is mounted to the annular projection.

20. The sealing system of claim 17, wherein the shaft region includes a cylindrical surface and the base includes a radial surface extending perpendicular from the cylindrical surface, and wherein the energizing structure comprises a Belleville spring member including an inner edge which engages the radial surface and an outer edge which engages the biasing surface of the third ring.

21. The sealing system of claim 17, wherein the shaft region includes a cylindrical surface and the base includes a radial surface extending perpendicular from the cylindrical surface, and wherein the energizing structure comprises a Belleville spring member including an outer edge which engages the radial surface and an inner edge which engages a force transfer ring, said force transfer ring configured to radially transfer the axial force for application to the biasing surface of the third ring.

22. The sealing system of claim 17, wherein the second ring includes an inwardly radially extending flange, and wherein the energizing structure comprises a Belleville spring member including an inner edge which engages the inwardly radially extending flange and an outer edge which engages the biasing surface of the third ring.

23. The sealing system of claim 17 wherein a metal face of the third ring comprises the second metal seal face and a coaxially arranged surface portion separated from the second metal seal face by an annular channel.

24. The sealing system of claim 23, wherein the second metal seal face is in sliding and sealing configuration with the first metal seal face on the first ring.

25. The sealing system of claim 23, wherein the coaxially arranged surface portion includes a plurality of radially extending channels connected to the annular channel.

26. The sealing system of claim 23, further including a plurality of radially extending passages passing through the third ring and connected to the annular channel.

27. The sealing system of claim 17, wherein a metal face of the third ring comprises the second metal seal face and the axial force is applied against the biasing surface of the third ring at a radial location that substantially radially corresponds to a radial center of the metal face.

28. The sealing system of claim 27, wherein the energizing structure comprises a plurality of spring members configured to apply axial force against the biasing surface of the third ring.

29. The sealing system of claim 28, each spring member is a coiled spring.

* * * * *

UNITED STATES PATENT AND TRADEMARK OFFICE

CERTIFICATE OF CORRECTION

PATENT NO. : 9,163,459 B2
APPLICATION NO. : 13/766166
DATED : October 20, 2015
INVENTOR(S) : Alan Otto Lebeck It is certified that error appears in the above-identified patent and that said Letters Patent is hereby corrected as shown below:

In the Claims:

At column 13, claim number 8, line number 47, please replace the word [farce] with the word -- force --.

At column 15, claim number 29, line number 19, please insert -- wherein -- before the word "each".

Signed and Sealed this
Ninth Day of August, 2016

Michelle K. Lee

Michelle K. Lee
*Director of the United States Patent and Trademark Office*